US010753656B2

(12) United States Patent
Taras et al.

(10) Patent No.: US 10,753,656 B2
(45) Date of Patent: Aug. 25, 2020

(54) LOW REFRIGERANT CHARGE MICROCHANNEL HEAT EXCHANGER

(71) Applicant: Carrier Corporation, Farmington, CT (US)

(72) Inventors: Michael F. Taras, Fayetteville, NY (US); Tobias H. Sienel, Baldwinsville, NY (US); Kazuo Saito, Jamesville, NY (US); Arindom Joardar, Jamesville, NY (US); Bruce J. Poplawski, Mattydale, NY (US)

(73) Assignee: CARRIER CORPORATION, Palm Beach, FL (US)

( * ) Notice: Subject to any disclaimer, the term of this patent is extended or adjusted under 35 U.S.C. 154(b) by 0 days.

(21) Appl. No.: 16/399,770

(22) Filed: Apr. 30, 2019

(65) Prior Publication Data

US 2019/0271492 A1 Sep. 5, 2019

Related U.S. Application Data

(63) Continuation of application No. 15/504,994, filed as application No. PCT/US2015/045866 on Aug. 19, 2015, now Pat. No. 10,288,331.
(Continued)

(51) Int. Cl.
*F25B 39/02* (2006.01)
*F28F 9/02* (2006.01)
(Continued)

(52) U.S. Cl.
CPC ..... *F25B 39/028* (2013.01); *F28D 1/05383* (2013.01); *F28D 1/05391* (2013.01);
(Continued)

(58) Field of Classification Search
CPC ..... F25B 39/028; F28D 1/05383; F28D 1/05391; F28D 7/16; F28D 9/0006;
(Continued)

(56) References Cited

U.S. PATENT DOCUMENTS 5,318,111 A 6/1994 Young et al.
5,806,586 A 9/1998 Osthues et al.
(Continued)

FOREIGN PATENT DOCUMENTS

EP 0706633 A1 4/1996
EP 1600208 A1 11/2005
(Continued)

OTHER PUBLICATIONS

European Patent Office Communication pursuant to Article 94(3) EPC, for Application No. 15756314.9-1008, dated May 17, 2018 (4 pages).
(Continued)

*Primary Examiner* — Justin M Jonaitis
(74) *Attorney, Agent, or Firm* — Cantor Colburn LLP

(57) ABSTRACT

A heat exchanger is provided including a first manifold, a second manifold separated from the first manifold, and a plurality of heat exchanger tubes arranged in spaced parallel relationship fluidly coupling the first and second manifolds. A first end of each heat exchange tube extends partially into an inner volume of the first manifold and has an inlet formed therein. A distributor is positioned within the inner volume of the first manifold. At least a portion of the distributor is arranged within the inlet formed in the first end of one or more of the plurality of heat exchange tubes.

15 Claims, 20 Drawing Sheets

Related U.S. Application Data

(60) Provisional application No. 62/161,056, filed on May 13, 2015, provisional application No. 62/039,154, filed on Aug. 19, 2014.

(51) Int. Cl.
*F28D 1/053* (2006.01)
*F28F 1/02* (2006.01)
*F25B 39/04* (2006.01)

(52) U.S. Cl.
CPC ..... *F28F 1/025* (2013.01); *F28F 9/028* (2013.01); *F28F 9/0273* (2013.01); *F25B 39/04* (2013.01); *F28F 2009/0285* (2013.01)

(58) Field of Classification Search
CPC ..... F28D 7/1607; F28F 1/025; F28F 9/0273; F28F 9/028; F28F 2009/0285; F28F 9/0219; F28F 2009/222; F28F 2225/02; F28F 9/0236; F28F 9/0243; F28F 9/04; F28F 9/22; F28F 9/24; F28F 2009/224; F28F 2009/226
USPC ..... 165/160, 157, 158, 159, 161, 162
See application file for complete search history.

(56) References Cited

U.S. PATENT DOCUMENTS

| | | | | |
|---|---|---|---|---|
| 6,179,051 | B1 | 1/2001 | Ayub | |
| 7,490,483 | B2 | 2/2009 | Boiarski et al. | |
| 8,113,270 | B2 * | 2/2012 | Rios | F25B 41/067 165/287 |
| 8,171,987 | B2 * | 5/2012 | Jiang | F25B 39/028 165/174 |
| 8,561,680 | B2 | 10/2013 | Jiang et al. | |
| 2006/0102331 | A1 | 5/2006 | Taras et al. | |
| 2009/0173482 | A1 * | 7/2009 | Beamer | F28D 1/05383 165/173 |
| 2010/0089559 | A1 * | 4/2010 | Gorbounov | F25B 39/028 165/174 |
| 2010/0116474 | A1 | 5/2010 | Kerler et al. | |
| 2011/0017438 | A1 | 1/2011 | Huazhao et al. | |
| 2012/0216563 | A1 | 8/2012 | Braunschweig et al. | |
| 2014/0202673 | A1 * | 7/2014 | Wand | F28F 9/0273 165/175 |
| 2017/0276411 | A1 | 9/2017 | Taras et al. | |

FOREIGN PATENT DOCUMENTS

| | | | |
|---|---|---|---|
| EP | 1844290 | A2 | 10/2007 |
| EP | 2079974 | A2 | 7/2009 |
| EP | 2597413 | A1 | 5/2013 |
| GB | 1016573 | A | 1/1966 |
| GB | 2483688 | A | 3/2012 |
| JP | H06117728 | A | 4/1994 |
| JP | 2009270795 | A | 11/2009 |
| WO | 2008064199 | A1 | 5/2008 |
| WO | 2008064709 | A1 | 6/2008 |
| WO | 2012006073 | A2 | 1/2012 |
| WO | 2014016127 | A1 | 1/2014 |

OTHER PUBLICATIONS

International Preliminary Report on Patentability issued in International Application No. PCT/US2015/045866, dated Feb. 21, 2017, 6 pages.
International Search Report for International Appln. No. PCT/US2015/045866; International Filing Date: Aug. 19, 2015; dated Oct. 20, 2015; 5 pages.
Written Opinion of the International Searching Authority for International Appln. No. PCT/US2015/045866; International Filing Date: Aug. 19, 2015; dated Oct. 20, 2015; 5 pages.
Chinese Office Action with english translation; CN Application No. 201580044141.6; dated Dec. 10, 2018; pp. 1-30.
European Search Report; International Application No. 19169594.9-1008; International Filing Date: Apr. 16, 2019; dated Jul. 22, 2019; 100 pages.

* cited by examiner

LOW REFRIGERANT CHARGE MICROCHANNEL HEAT EXCHANGER

CROSS-REFERENCE TO RELATED APPLICATIONS

This application is a continuation application of U.S. application Ser. No. 15/504,994, filed Feb. 17, 2017, which is a National Stage Application of PCT/US2015/045866, filed Aug. 19, 2015, which claims the benefit of U.S. provisional patent application Ser. No. 62/161,056 filed May 13, 2015 and U.S. provisional patent application Ser. No. 62/039,154 filed Aug. 19, 2014, the entire contents of which are incorporated herein by reference.

BACKGROUND

This disclosure relates generally to heat exchangers and, more particularly, to a microchannel heat exchanger for use in heat pump applications.

One type of refrigerant system is a heat pump. A heat pump can be utilized to heat air being delivered into an environment to be conditioned, or to cool and typically dehumidify the air delivered into the indoor environment. In a basic heat pump, a compressor compresses a refrigerant and delivers it downstream through a refrigerant flow reversing device, typically a four-way reversing valve. The refrigerant flow reversing device initially routes the refrigerant to an outdoor heat exchanger, if the heat pump is operating in a cooling mode, or to an indoor heat exchanger, if the heat pump is operating in a heating mode. From the outdoor heat exchanger, the refrigerant passes through an expansion device, and then to the indoor heat exchanger, in the cooling mode of operation. In the heating mode of operation, the refrigerant passes from the indoor heat exchanger to the expansion device and then to the outdoor heat exchanger. In either case, the refrigerant is routed through the refrigerant flow reversing device back into the compressor. The heat pump may utilize a single bi-directional expansion device or two separate expansion devices.

In recent years, much interest and design effort has been focused on the efficient operation of the heat exchangers (indoor and outdoor) in heat pumps. High effectiveness of the refrigerant system heat exchangers directly translates into the augmented system efficiency and reduced life-time cost. One relatively recent advancement in heat exchanger technology is the development and application of parallel flow, microchannel or minichannel heat exchangers, as the indoor and outdoor heat exchangers.

These parallel flow heat exchangers are provided with a plurality of parallel heat transfer tubes, typically of a non-round shape, among which refrigerant is distributed and flown in a parallel manner. The heat exchanger tubes typically incorporate multiple channels and are oriented substantially perpendicular to a refrigerant flow direction in the inlet and outlet manifolds that are in communication with the heat transfer tubes. Heat transfer enhancing fins are typically disposed between and rigidly attached to the heat exchanger tubes. The primary reasons for the employment of the parallel flow heat exchangers, which usually have aluminum furnace-brazed construction, are related to their superior performance, high degree of compactness, structural rigidity, and enhanced resistance to corrosion.

The growing use of low global warming potential refrigerants introduces another challenge related to refrigerant charge reduction. Current legislation limits the amount of charge of refrigerant systems, and heat exchangers in particular, containing most low global warming potential refrigerants (classified as A2L substances). Microchannel heat exchangers have a small internal volume and therefore store less refrigerant charge than conventional round tube plate fin heat exchangers. In addition, the refrigerant charge contained in the manifolds of the microchannel heat exchanger is a significant portion, about a half, of the total heat exchanger charge. As a result, the refrigerant charge reduction potential of the heat exchanger is limited.

SUMMARY

According to an embodiment of the present disclosure, a heat exchanger is provided including a first manifold, a second manifold separated from the first manifold, and a plurality of heat exchanger tube arranged in spaced parallel relationship fluidly coupling the first and second manifolds. A first end of each heat exchange tube extends partially into an inner volume of the first manifold and has an inlet formed therein. A distributor is positioned within the inner volume of the first manifold. At least a portion of the distributor is arranged within the inlet formed in the first end of one or more of the plurality of heat exchange tubes.

In addition to one or more of the features described above, or as an alternative, in further embodiments the first manifold is configured to receive at least a partially liquid refrigerant In addition to one or more of the features described above, or as an alternative, in further embodiments a height of the first manifold is less than a width of the first manifold In addition to one or more of the features described above, or as an alternative, in further embodiments the first manifold is asymmetric about a horizontal plane extending there through.

In addition to one or more of the features described above, or as an alternative, in further embodiments the inlet formed in the first end is generally complementary to a contour of the distributor.

In addition to one or more of the features described above, or as an alternative, in further embodiments the inlet extends over only a portion of a width of the heat exchanger tube.

In addition to one or more of the features described above, or as an alternative, in further embodiments the distributor has an increased wall thickness to reduce the inner volume of the first manifold.

In addition to one or more of the features described above, or as an alternative, in further embodiments wherein the distributor occupies between about 20% and about 60% of the inner volume of the first manifold.

In addition to one or more of the features described above, or as an alternative, in further embodiments the distributor occupies between about 30% and about 50% of the inner volume of the first manifold.

In addition to one or more of the features described above, or as an alternative, in further embodiments a porous structure is arranged within the inner volume of the manifold.

In addition to one or more of the features described above, or as an alternative, in further embodiments the distributor is arranged within the porous structure.

In addition to one or more of the features described above, or as an alternative, in further embodiments the porous structure has a porosity between about 30% and about 70%.

In addition to one or more of the features described above, or as an alternative, in further embodiments the porosity of the porous structure is non-uniform.

In addition to one or more of the features described above, or as an alternative, in further embodiments the porosity of the porous structure is increased to have localized flow resistance.

In addition to one or more of the features described above, or as an alternative, in further embodiments the porosity of the porous structure changes uniformly along the length of the first manifold.

In addition to one or more of the features described above, or as an alternative, in further embodiments the porous structure includes a plurality of cavities. Each cavity is configured to receive the first end of one of the plurality of heat exchanger tubes.

In addition to one or more of the features described above, or as an alternative, in further embodiments the first manifold is one of an inlet manifold and an intermediate manifold.

In addition to one or more of the features described above, or as an alternative, in further embodiments a spacer is positioned adjacent the distributor. The spacer is configured to set a position of the distributor within the inner volume of the first manifold.

In addition to one or more of the features described above, or as an alternative, in further embodiments the spacer is configured to contact at least one of the plurality of heat exchanger tubes.

In addition to one or more of the features described above, or as an alternative, in further embodiments the spacer is configured to contact a portion of the first manifold inner wall.

In addition to one or more of the features described above, or as an alternative, in further embodiments the spacer extends over a portion of a length of the distributor.

In addition to one or more of the features described above, or as an alternative, in further embodiments the spacer includes a plurality of protrusions extending over at least a portion of a length of the distributor.

In addition to one or more of the features described above, or as an alternative, in further embodiments the distributor further comprises a groove formed in an exterior surface thereof. The groove and an interior wall of the first manifold form a flow passage between a first manifold section and a second manifold section.

In addition to one or more of the features described above, or as an alternative, in further embodiments the groove comprises a plurality of separate grooves.

In addition to one or more of the features described above, or as an alternative, in further embodiments the groove comprises an interconnected groove.

In addition to one or more of the features described above, or as an alternative, in further embodiments the groove comprises a spiral pattern along a circumference of the distributor.

In addition to one or more of the features described above, or as an alternative, in further embodiments the groove is configured such that a fluid flowing through the groove is not directly injected into any of the plurality of heat exchanger tubes.

In addition to one or more of the features described above, or as an alternative, in further embodiments the flow direction imparted to a fluid flowing through the groove is not parallel with one or more of the plurality of heat exchanger tubes.

In addition to one or more of the features described above, or as an alternative, in further embodiments the groove comprises a plurality of grooves. A total cross-sectional flow area of the plurality of grooves is less than a cross-sectional flow area of the first manifold.

In addition to one or more of the features described above, or as an alternative, in further embodiments the total cross-sectional area is between 50% and 200% of a cross-sectional flow area of the first manifold section.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
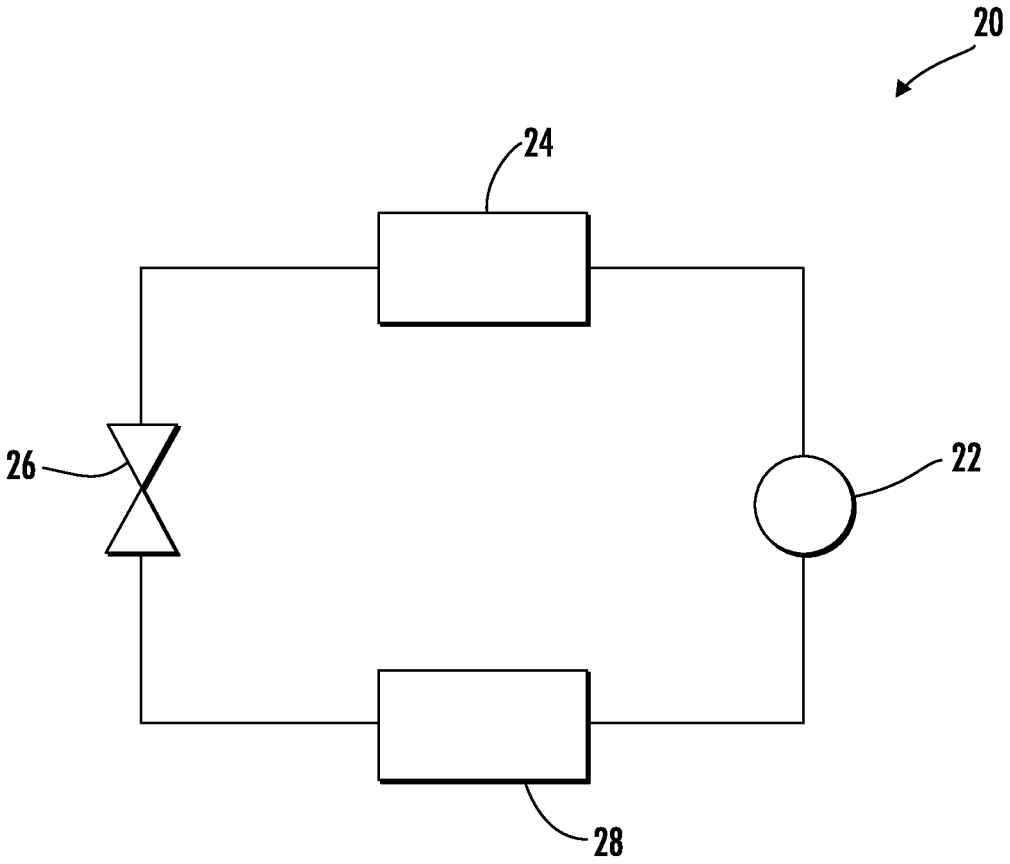
FIG. 1 is a schematic diagram of an example of a refrigeration system.

An example of a vapor compression system 20 is illustrated in FIG. 1, including a compressor 22, configured to compress a refrigerant and deliver it downstream to a condenser 24. From the condenser 24, the cooled liquid refrigerant passes through an expansion device 26 to an evaporator 28. From the evaporator 28, the refrigerant is returned to the compressor 22 to complete the closed-loop refrigerant circuit.

Figure 2:
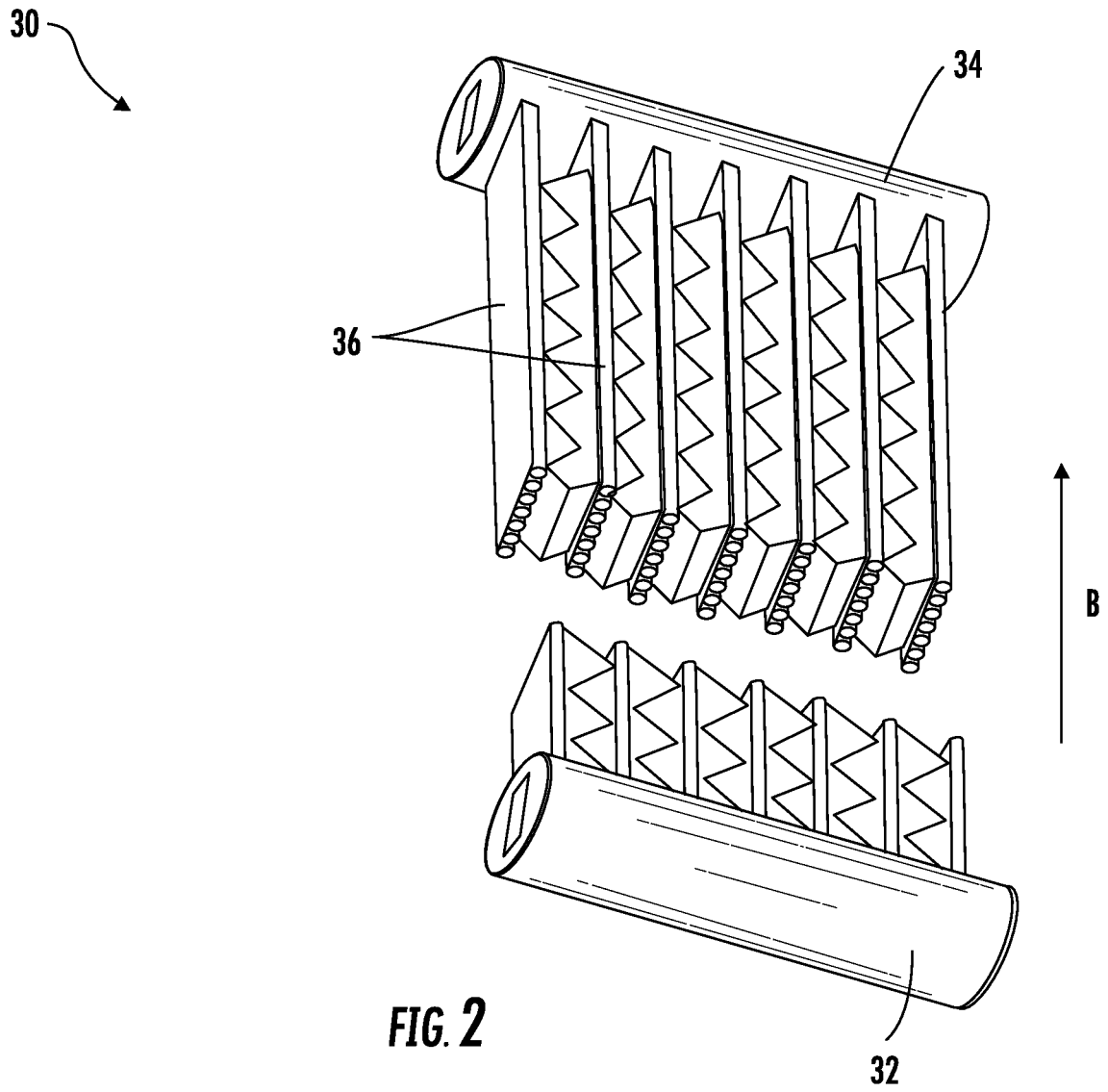
FIG. 2 is a perspective view of a microchannel heat exchanger according to an embodiment of the present disclosure.
Figure 3:
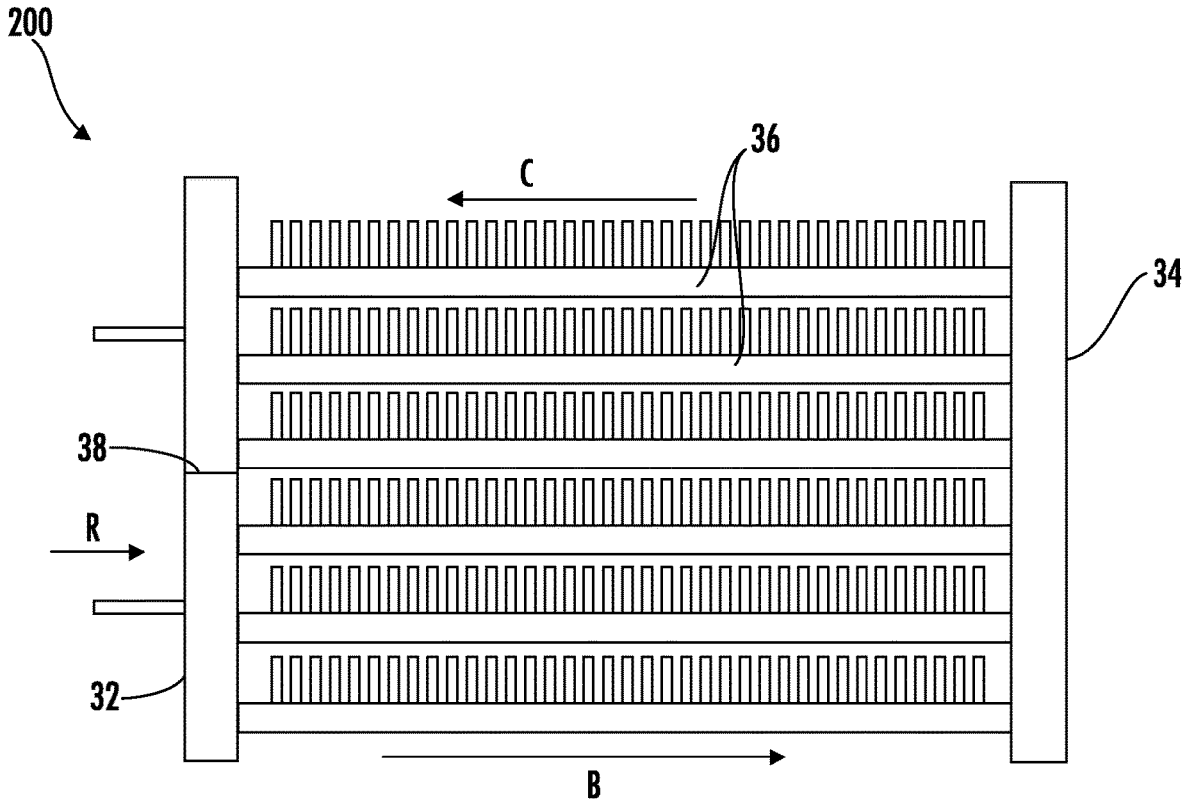
FIG. 3 is a cross-sectional view of a microchannel heat exchanger according to an embodiment of the present disclosure.
Figure 4:
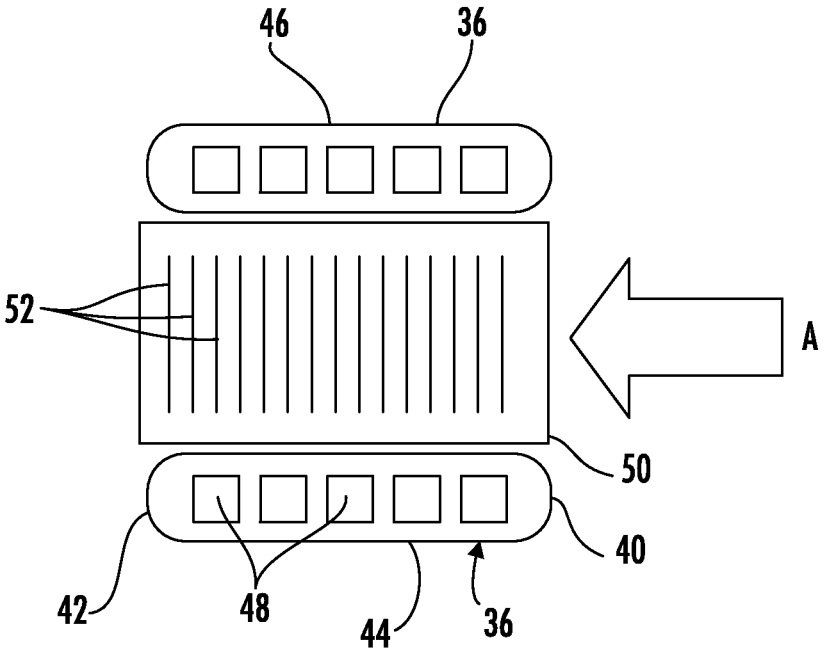
FIG. 4 is a cross-sectional view of a microchannel heat exchanger according to an embodiment of the present disclosure.

Referring now to FIGS. 2-4, a heat exchanger 30 configured for use in the vapor compression system 20 is illustrated in more detail. In the illustrated non-limiting embodiment, the heat exchanger 30 is a single tube bank microchannel heat exchanger 30; however, microchannel heat exchangers having multiple tube banks are within the scope of the present disclosure. The heat exchanger 30 includes a first manifold or header 32, a second manifold or header 34 spaced apart from the first manifold 32, and a plurality of heat exchange tubes 36 extending in a spaced parallel relationship between and connecting the first manifold 32 and the second manifold 34. In the illustrated, non-limiting embodiments, the first header 32 and the second header 34 are oriented generally horizontally and the heat exchange tubes 36 extend generally vertically between the two manifolds 32, 34. The heat exchanger 30 may be used as either a condenser 24 or an evaporator 28 in the vapor compression system 20. By arranging the tubes 36 vertically, water condensate collected on the tubes 36 is more easily drained from the heat exchanger 30.

The heat exchanger 30 may be configured in a single pass arrangement, such that refrigerant flows from the first header 32 to the second header 34 through the plurality of heat exchanger tubes 36 in the flow direction indicated by arrow B (FIG. 2). In another embodiment, the heat exchanger 30 is configured in a multi-pass flow arrangement. For example, with the addition of a divider or baffle 38 in the first header 32 (FIG. 3), fluid is configured to flow from the first manifold 32 to the second manifold 34, in the direction indicated by arrow B, through a first portion of the heat exchanger tubes 36, and back to the first manifold 32, in the direction indicated by arrow C, through a second portion of the heat exchanger tubes 36. The heat exchanger 30 may additionally include guard or "dummy" tubes (not shown) extending between its first and second manifolds 32, 34 at the sides of the tube bank. These "dummy" tubes do not convey refrigerant flow, but add structural support to the tube bank.

Referring now to FIG. 4, each heat exchange tube 36 comprises a flattened heat exchange tube having a leading edge 40, a trailing edge 42, a first surface 44, and a second surface 46. The leading edge 40 of each heat exchanger tube 36 is upstream of its respective trailing edge 42 with respect to an airflow A through the heat exchanger 36. The interior flow passage of each heat exchange tube 36 may be divided by interior walls into a plurality of discrete flow channels 48 that extend over the length of the tubes 36 from an inlet end to an outlet end and establish fluid communication between the respective first and second manifolds 32, 34. The flow channels 48 may have a circular cross-section, a rectangular cross-section, a trapezoidal cross-section, a triangular cross-section, or another non-circular cross-section. The heat exchange tubes 36 including the discrete flow channels 48 may be formed using known techniques and materials, including, but not limited to, extruded or folded.

As known, a plurality of heat transfer fins 50 may be disposed between and rigidly attached, usually by a furnace braze process, to the heat exchange tubes 36, in order to enhance external heat transfer and provide structural rigidity to the heat exchanger 30. Each folded fin 50 is formed from a plurality of connected strips or a single continuous strip of fin material tightly folded in a ribbon-like serpentine fashion thereby providing a plurality of closely spaced fins 52 that extend generally orthogonal to the flattened heat exchange tubes 36. Heat exchange between the fluid within the heat exchanger tubes 36 and air flow A, occurs through the outside surfaces 44, 46 of the heat exchange tubes 36 collectively forming the primary heat exchange surface, and also through the heat exchange surface of the fins 52 of the folded fin 50, which form the secondary heat exchange surface.

Figure 5:
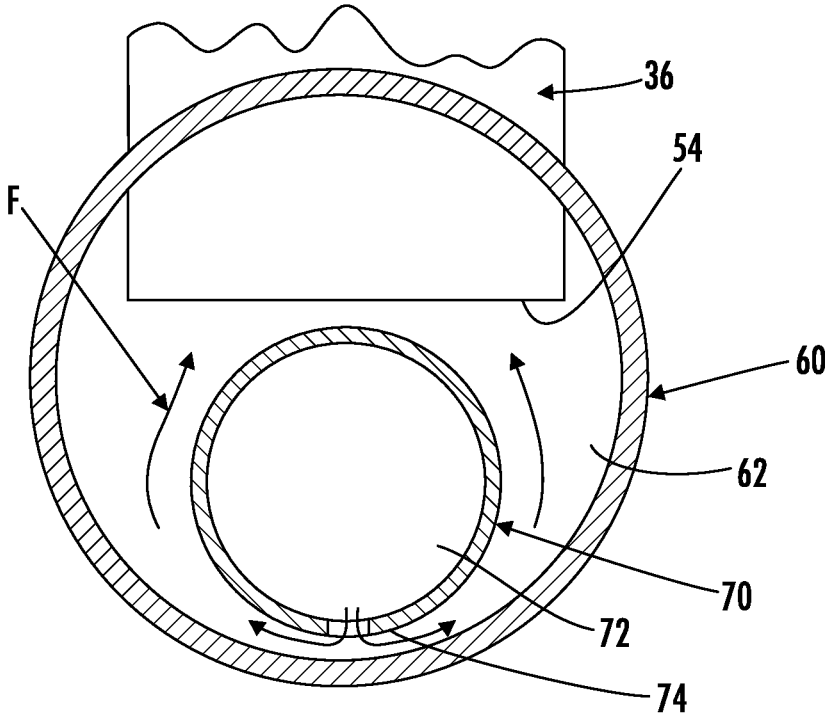
FIG. 5 (PRIOR ART)
FIG. 5 is a cross-section of a conventional manifold of the microchannel heat exchanger.
Figure 6:
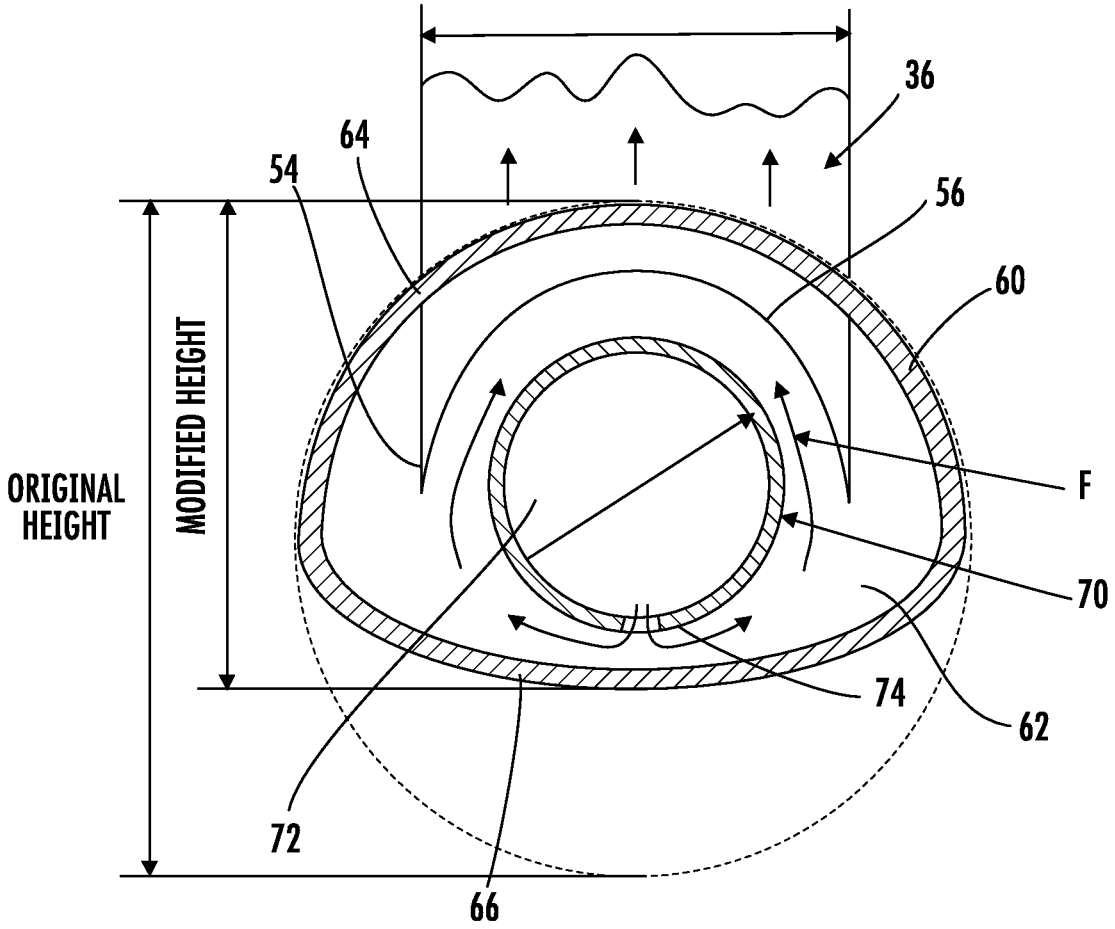
FIG. 6 is a cross-section of a manifold of a microchannel heat exchanger having a reduced inner volume according to an embodiment of the present disclosure.

An example of a cross-section of a conventional manifold 60, such as manifold 32 or 34 for example, is illustrated in FIG. 5. As shown, the manifold 60 has a generally circular cross-section and the ends 54 of the heat exchanger tubes 36 are configured to extend at least partially into the inner volume 62 of the manifold 60. A longitudinally elongated distributor 70, as is known in the art, may be arranged within one or more chambers of the manifold 60. The distributor 70 is arranged generally centrally within the inner volume of the manifold 62 and is configured to evenly distribute the flow of refrigerant between the plurality of heat exchanger tubes 36 fluidly coupled thereto. The inner volume 62 of the manifold 60 must therefore be large enough to contain the tube ends 54 and a distributor 70 in a spaced apart relation such that an unobstructed fluid flow path exists from an inner volume 72 of the distributor 70 to an inner volume 62 of the manifold 60 and into the ends 54 of the heat exchanger tubes 36.

Referring now to FIGS. 6-18, a manifold 60 of the heat exchanger, such as a liquid manifold or a portion of a manifold configured to receive a liquid refrigerant for example, has a reduced inner volume 62 compared to the conventional manifold of FIG. 5. The inner volume 62 of the manifold 60 is reduced by about 20% to about 60%, and more specifically by about 30% to about 50% depending on other operational and design parameters of the heat exchanger 20. Various methods exist for reducing the inner volume 62 of the manifold 60.

Figure 7:
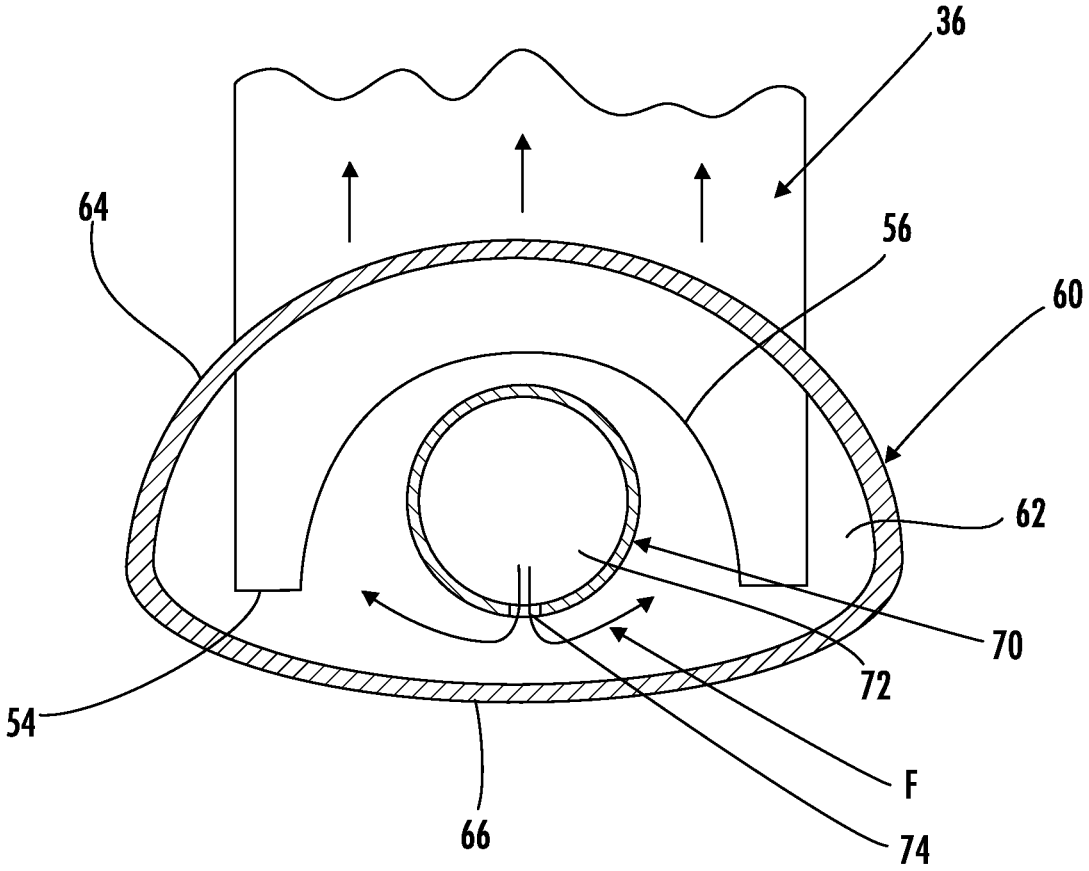
FIG. 7 is a cross-section of another manifold of a microchannel heat exchanger having a reduced inner volume according to an embodiment of the present disclosure.
Figure 8:
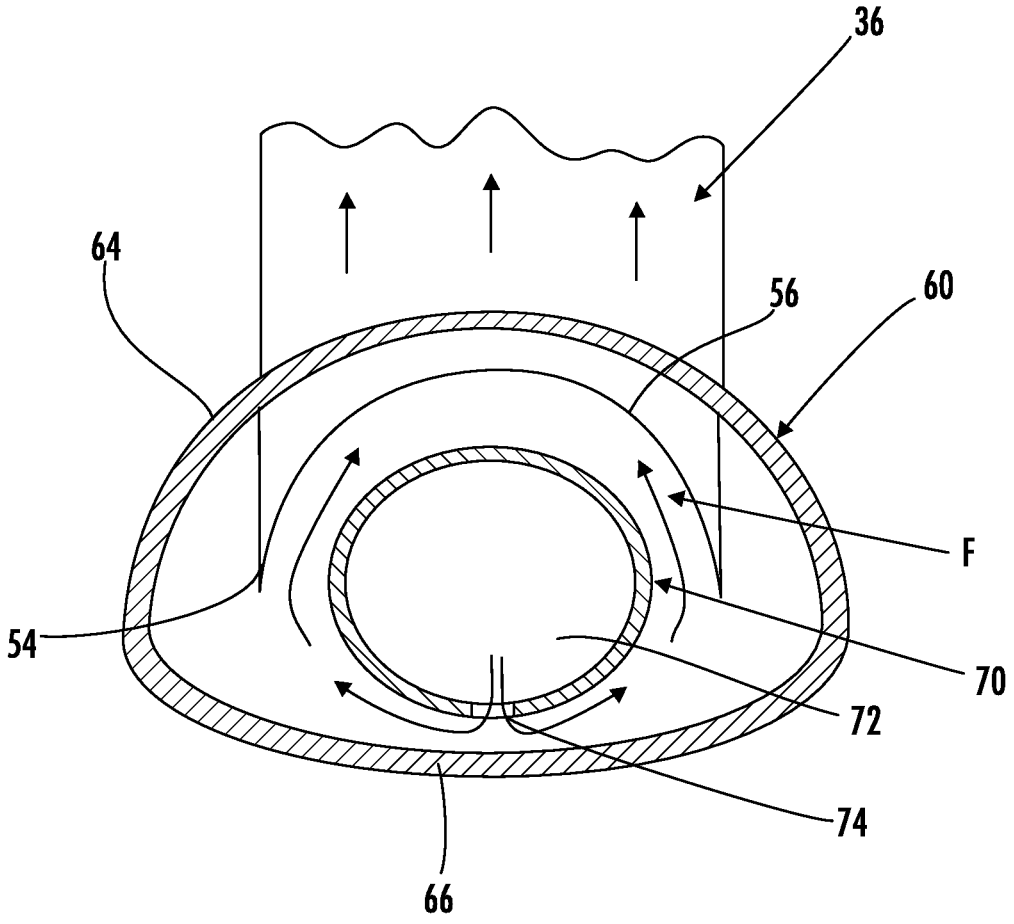
FIG. 8 is a cross-section of another manifold of a microchannel heat exchanger having a reduced inner volume according to an embodiment of the present disclosure.
Figure 9:
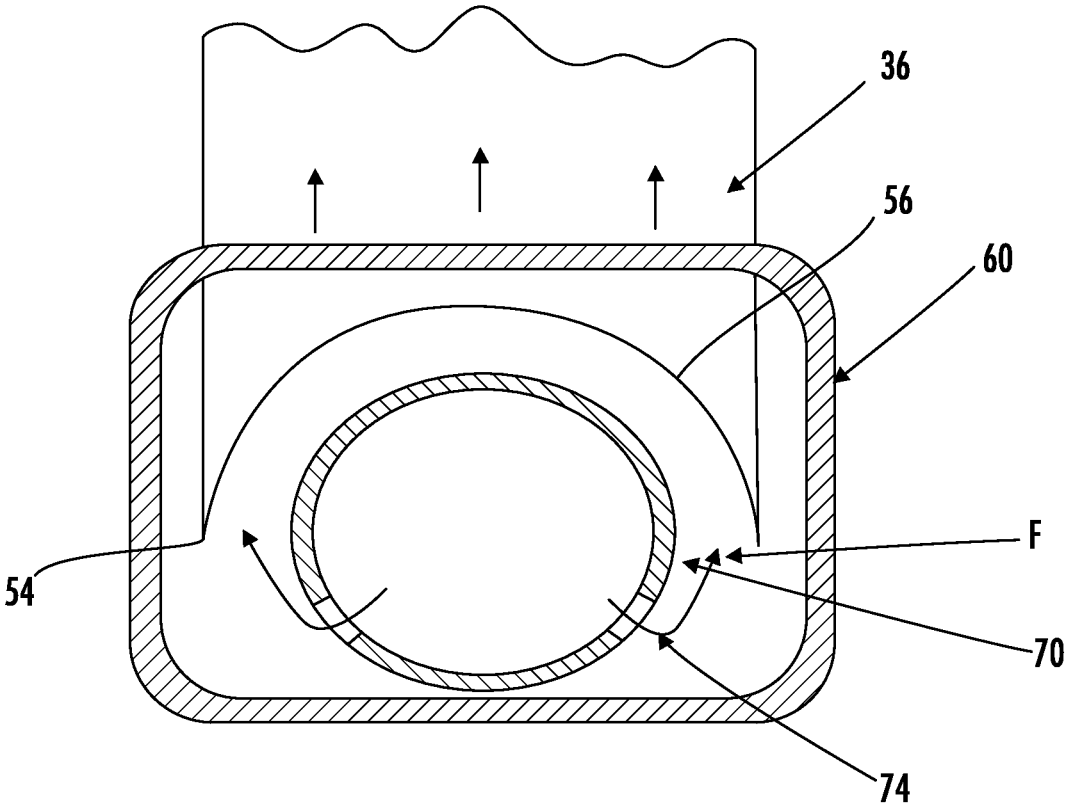
FIG. 9 is a cross-section of another manifold of a microchannel heat exchanger having a reduced inner volume according to an embodiment of the present disclosure.
Figure 10:
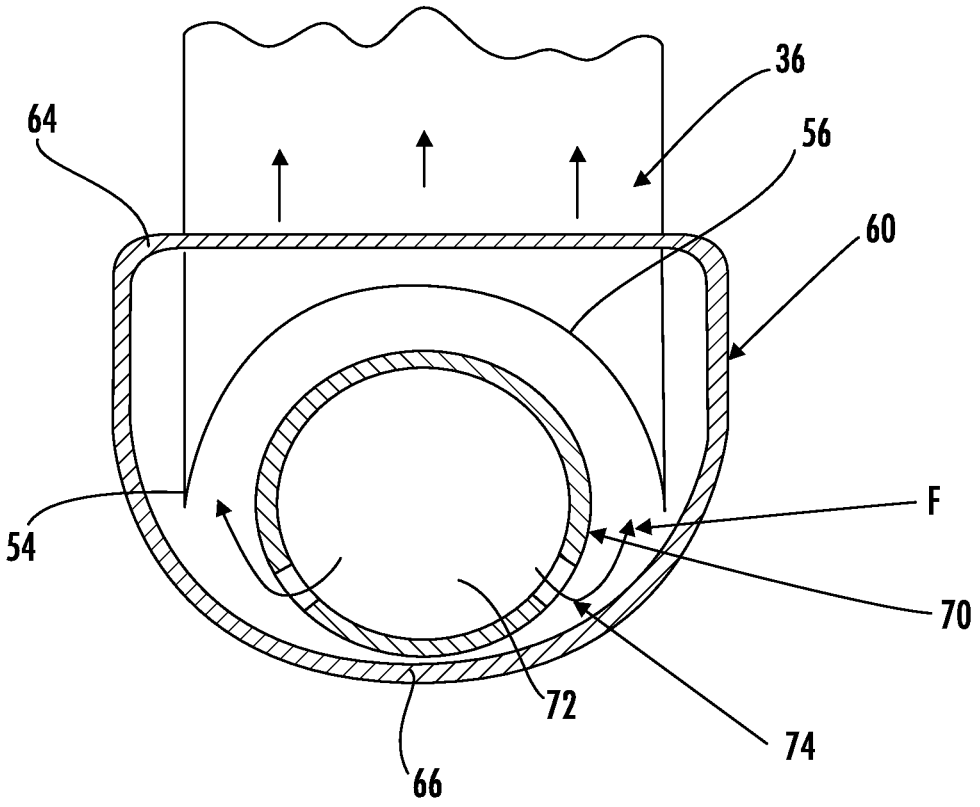
FIG. 10 is a cross-section of another manifold of a microchannel heat exchanger having a reduced inner volume according to an embodiment of the present disclosure.
Figure 11:
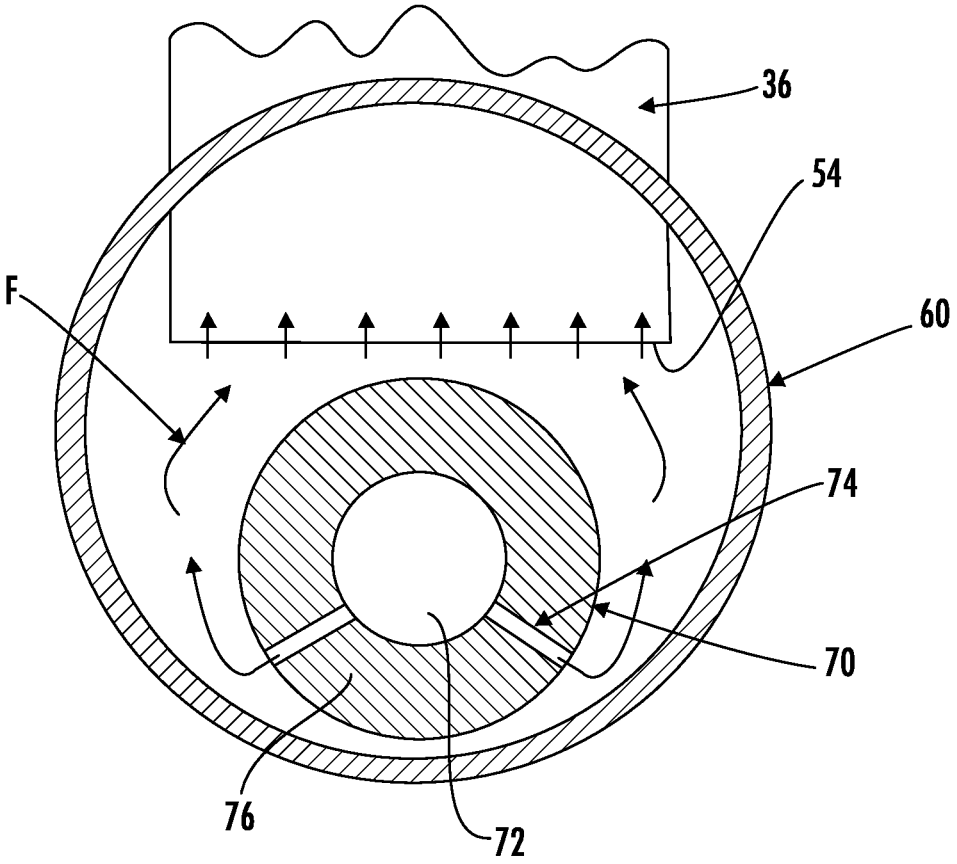
FIG. 11 is a cross-section of another manifold of a microchannel heat exchanger having a reduced inner volume according to an embodiment of the present disclosure.
Figure 12:
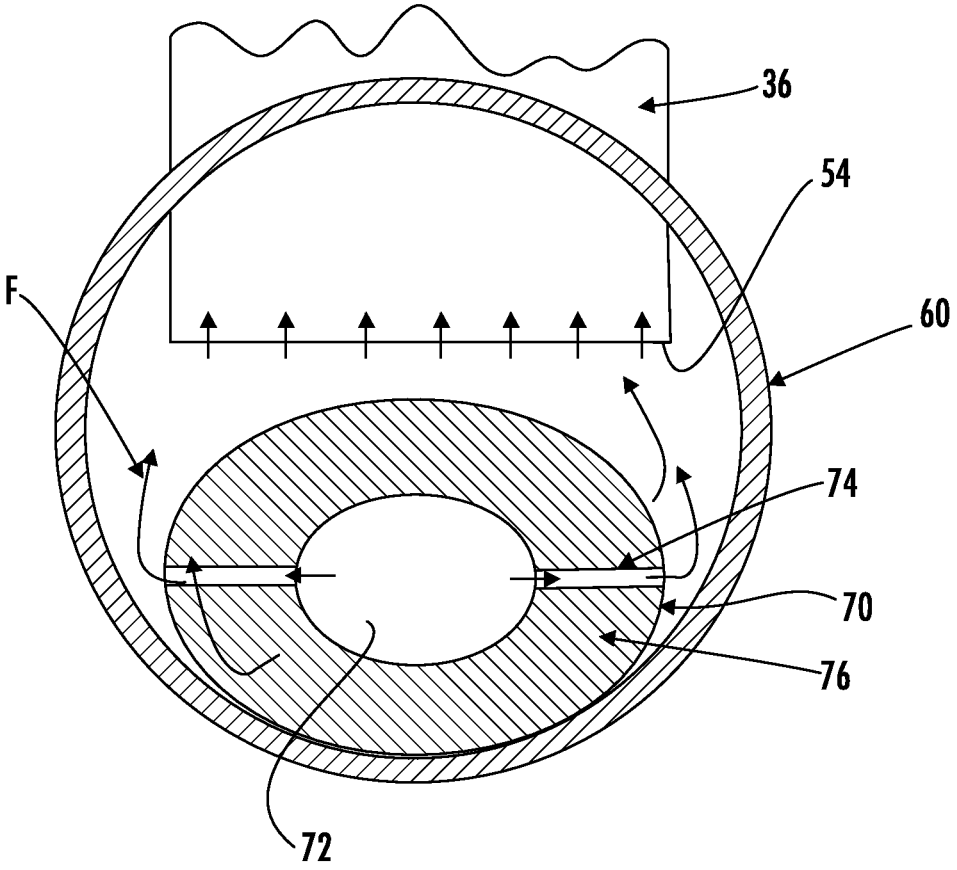
FIG. 12 is a cross-section of another manifold of a microchannel heat exchanger having a reduced inner volume according to an embodiment of the present disclosure.
Figure 13:
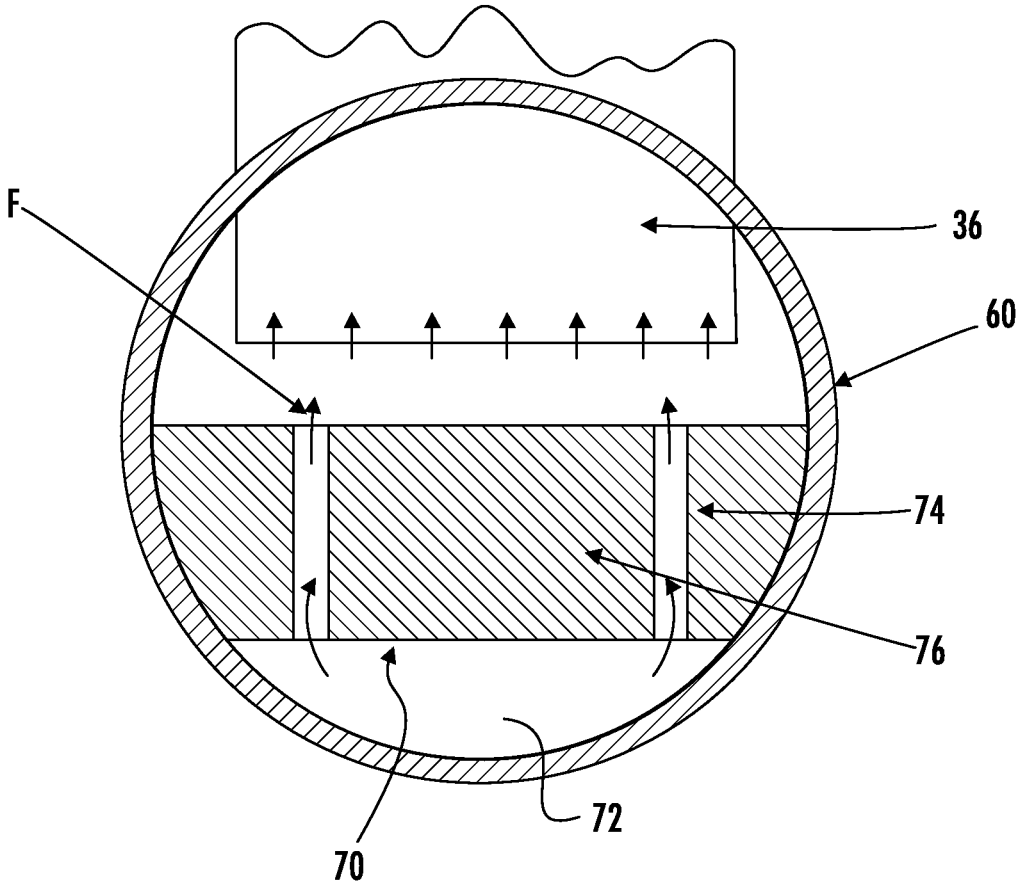
FIG. 13 is a cross-section of another manifold of a microchannel heat exchanger having a reduced inner volume according to an embodiment of the present disclosure.

As illustrated in FIGS. 6-10, the inner volume 62 of the manifold 60 may be reduced by changing the shape of the end 54 of the heat exchanger tubes 36, by altering the cross-sectional shape of the manifold 60, or a combination including at least one of the foregoing. Such modifications can improve compactness of the heat exchanger and/or aid in positioning the distributor 70 within the manifold 60. In each of the FIGS., a generally concave inlet or cut 56 is formed in the end 54 of each of the heat exchange tubes 36 positioned within the manifold 60. The cut 56 may have a curvature generally complementary to a curvature of the distributor 70, or may be different, as shown in FIG. 7. In addition, the cut 56 can extend over the entire width, or alternatively, over only a portion of the width of the heat exchanger tube 36 and is generally at least equal to the width of the distributor 70. As a result, at least a portion of the distributor 70 is arranged within the inlet 56 formed the heat exchanger tube end 54.

The width of the manifold 60 must be at least equal to or greater than a width of the heat exchanger tubes 36 received therein. By positioning a portion of the distributor 70 within the inlet 56 formed at the end 54 of the heat exchanger tubes 36, the overall height of the manifold 60 may be reduced. As a result, the cross-section of the manifold may be asymmetrical about a horizontal plane. For example, the contour curvature of an upper portion 64 and a lower portion 66 of the manifold 60 may be substantially different. As shown in the non-limiting embodiment illustrated in FIGS. 6-8, the upper portion 64 of the manifold 60 may be substantially semi-spherical in shape and the lower portion 66 of the manifold 60 may have a generally ellipsoid contour. In another embodiment, shown in FIG. 9, the manifold 60 is generally rectangular in shape. In yet another embodiment, illustrated in FIG. 10, the manifold 60 may be substantially D-shaped, such that the upper portion 64 of the manifold 60 is substantially flat and the lower portion 66 of the manifold 60 forms the general curved portion of the D. The shapes of the distributors 70 and manifolds 60 illustrated and described herein are non-limiting, and other variations are within the scope of the present disclosure.

Figure 14:
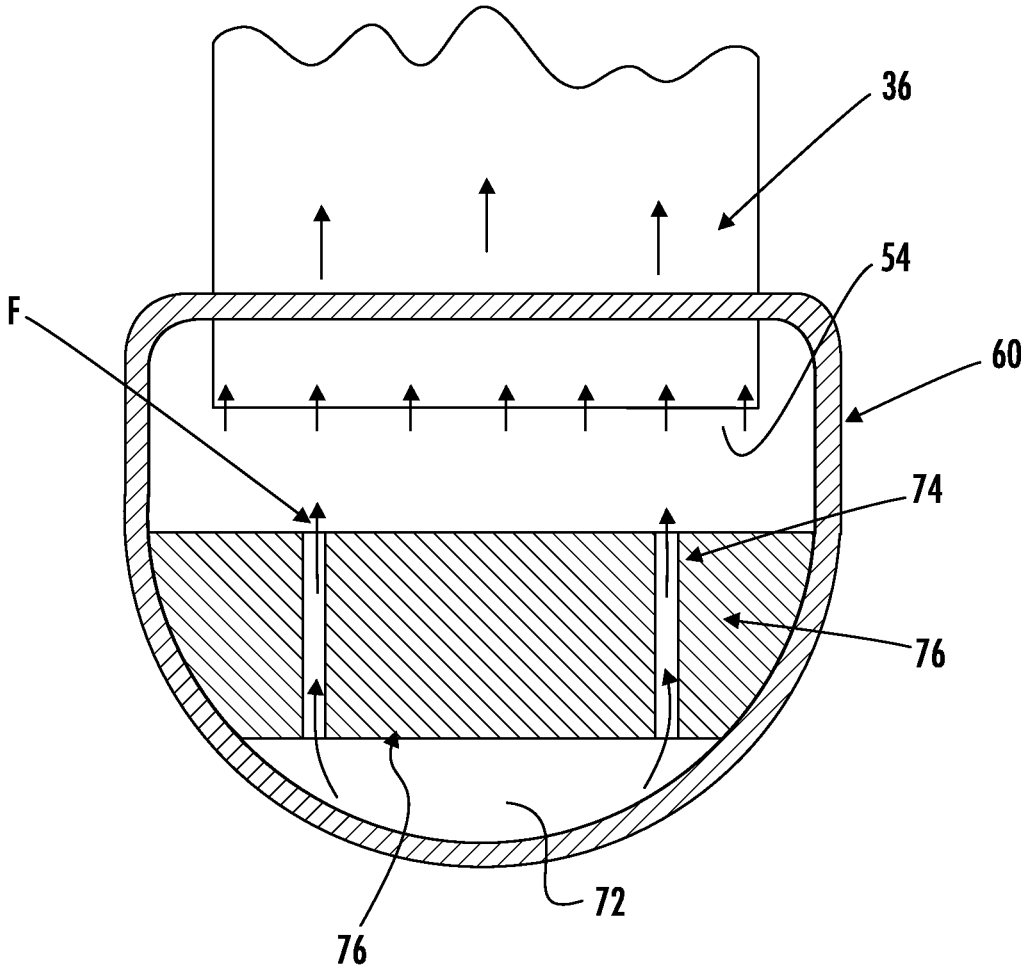
FIG. 14 is a cross-section of another manifold of a microchannel heat exchanger having a reduced inner volume according to an embodiment of the present disclosure.
Figure 15:
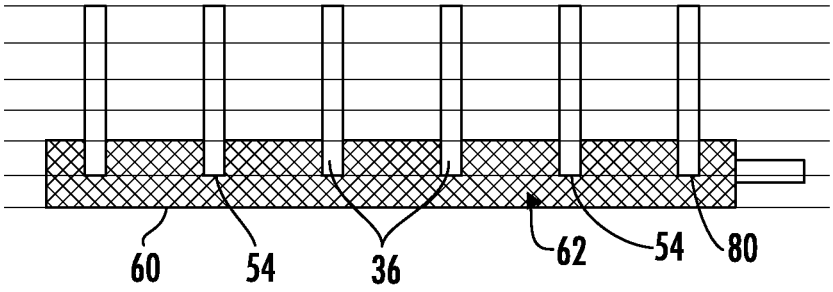
FIG. 15 is a cross-section of a manifold of a microchannel heat exchanger having a reduced inner volume according to an embodiment of the present disclosure.

Referring now to FIGS. 11-14, the inner volume 62 of the manifold 60 may also be reduced by increasing the thickness of the distributor wall 72 such that the distributor 70 itself occupies a larger portion of the inner volume 62. In one embodiment, the thickness of the distributor wall 76 is increased to occupy between about 20% and about 60% of the inner volume 62. The interior volume 72 of the distributor 70, as well as the size and arrangement of the distributor holes 74 configured to distribute refrigerant from the distributor 70 to the inner volume 62 of the manifold 60, however, will generally remain unchanged. The distributor 70 may be any type of distributor, including, but not limited to a circular distributor (FIG. 11), an ellipsoid distributor (FIG. 12), and a plate distributor as shown in the FIGS. 13 and 14 for example. A distributor 70 having an increased wall thickness may also be used in conjunction with the method of reducing the inner volume 62 of the manifold 60 previously described. For example, a distributor plate 70 have an increased wall thickness may be arranged within a manifold 60 having a D-shaped cross-section as illustrated in FIG. 14, or a circular distributor 70 having an increased wall thickness may be at least partially arranged within the cut or inlet 56 formed in the ends 54 of the heat exchanger tubes 36.

Referring now to FIGS. 15-18, a formed porous structure 80 may be positioned within the manifold 60 to reduce the inner volume 62 thereof. The porous structure 80 be formed from a metal or non-metal material, such as a foam, mesh, woven wire or thread, or a sintered metal for example, and has a uniform or non-uniform porosity between about 30% and about 70%. The porous structure 80 has a size and shape generally complementary to the inner volume 62 of the manifold 60. The porosity of the porous structure 80 may be configured to change, such as uniformly for example, along the length of the manifold 60 in the direction of the refrigerant flow. In one embodiment, shown in FIG. 18, the porous structure 80 is formed with a plurality of pockets or cavities 82, each cavity 82 being configured to receive or accommodate one of the heat exchange tubes 36 extending into the manifold 60.

Figure 16:
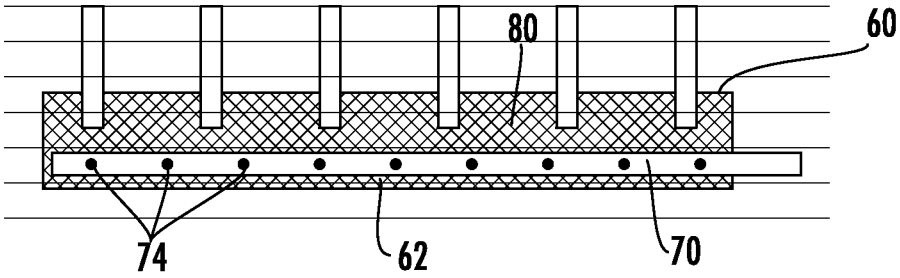
FIG. 16 is a cross-section of a manifold of a microchannel heat exchanger having a reduced inner volume according to an embodiment of the present disclosure.
Figure 17:
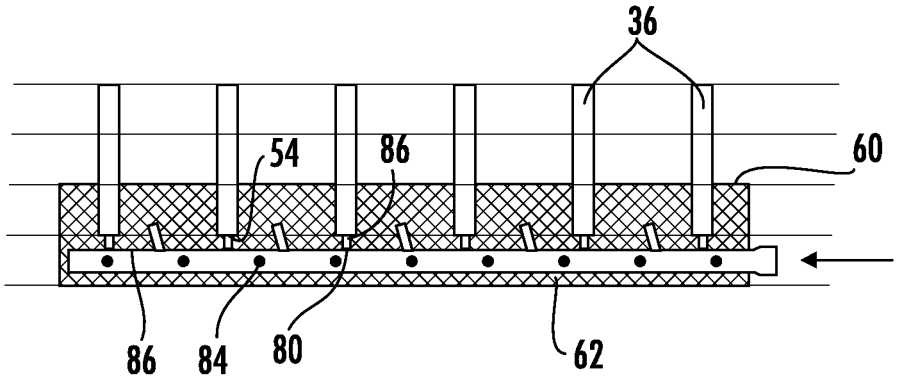
FIG. 17 is a cross-section of a manifold of a microchannel heat exchanger having a reduced inner volume according to an embodiment of the present disclosure.
Figure 18:
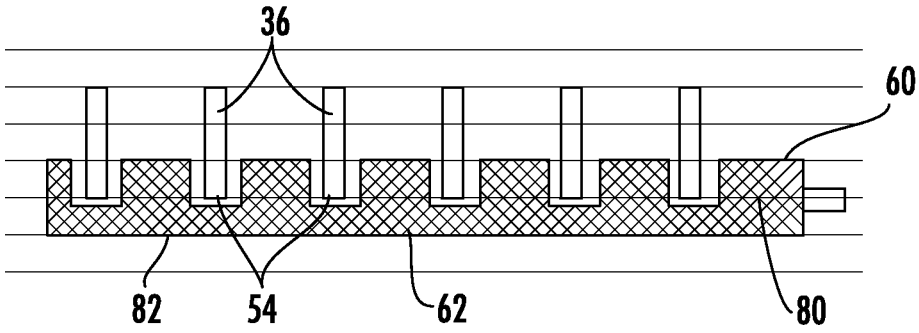
FIG. 18 is a cross-section of a manifold of a microchannel heat exchanger having a reduced inner volume according to an embodiment of the present disclosure.

In another embodiment, illustrated in FIG. 17, a distribution channel 84 may be formed over at least a portion of the length of the porous structure 80. The size and shape of the distribution channel 84 may be constant or may vary and one or more side channels 86 may extend therefrom to uniformly distribute the refrigerant from the distribution channel 84 to each of the heat exchange tubes 36. Alternatively, a distributor 70 having a plurality of distributor openings 74 may be inserted within the porous structure 80 (FIG. 16). In such embodiments, the porous structure 80 is configured to position and support the distributor 70 within the manifold 60. In addition, the porous structure may include other provisions, such as relief pockets and enlarged clearances for example, may be added as necessary to maintain the integrity of the heat exchanger. In one embodiment, localized portions of the porous structure 80 may have an increased porosity to provide localized flow resistance.

The porous structure 80 may be integrally formed with the manifold 60, or alternatively, may be a separate removable sub-assembly inserted into the inner volume 62 of the manifold 60. The porous structure 80 may be combined with any of the previously described systems having a reduced inner volume. For example, a distributor 70 having an increased wall thickness may be inserted into the porous structure 80, or the porous structure 80 may be added to a manifold 60 having a reduced height.

The vapor compression system 20 can be used in a heat pump application. In such applications, the vapor compression system may encompass auxiliary devices such as an accumulator, charge compensator, receiver, air management systems, or a combination including at least one of the foregoing. For example, one or more air management systems can be utilized to provide the airflow over an indoor and/or outdoor heat exchanger (e.g., condenser 24, evaporator 28, or an auxiliary heat exchanger configured to thermally communicate with the refrigerant circuit). The one or more air management systems can facilitate heat transfer interaction between the refrigerant circulating throughout the refrigerant circuit and the indoor and/or outdoor environment respectively.

Figure 19:
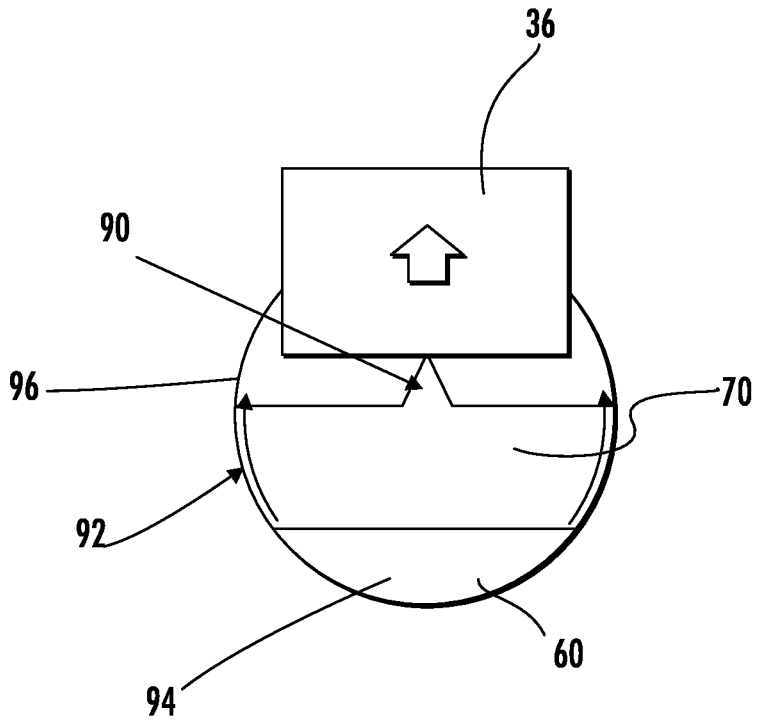
FIG. 19 is a cross-section of a manifold of a microchannel heat exchanger having a reduced inner volume according to an embodiment of the present disclosure.
Figure 19A:
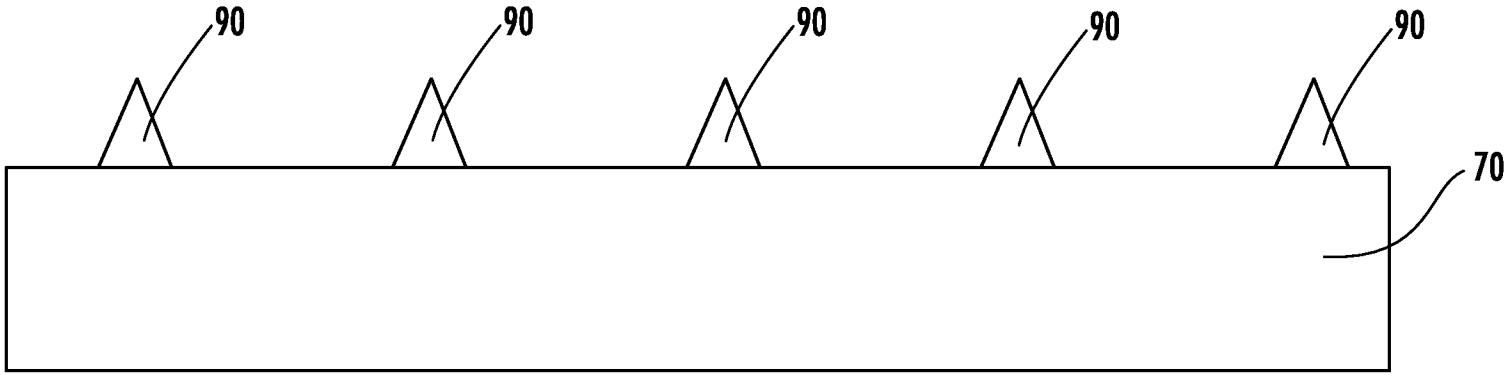
FIG. 19*a* is a side view of a distributor of a microchannel heat exchanger according to an embodiment of the present disclosure.
Figure 20:
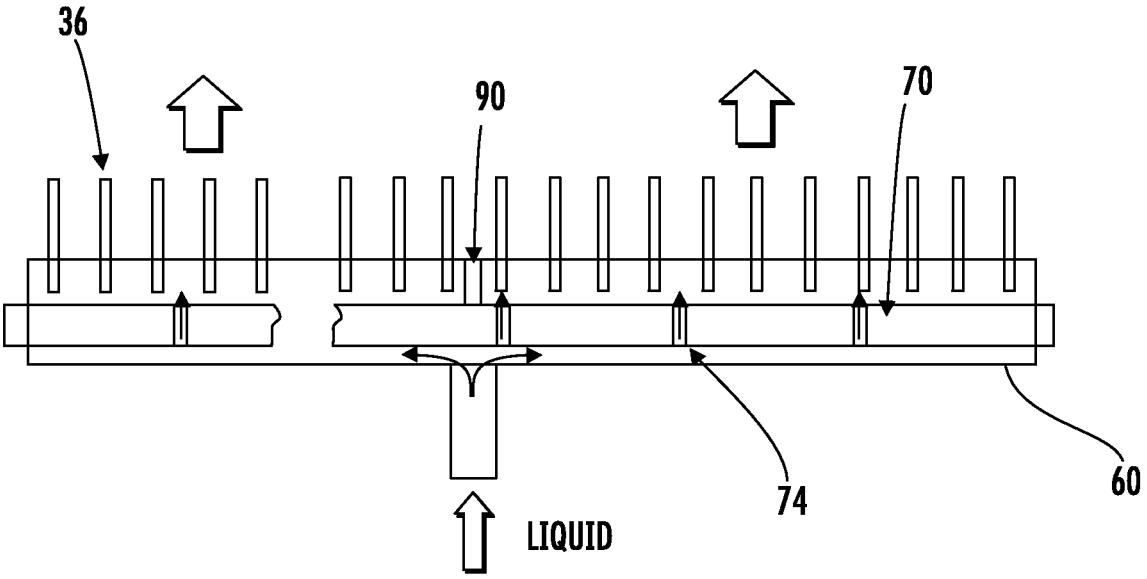
FIG. 20 is another cross-section of a manifold of a microchannel heat exchanger having a reduced inner volume according to an embodiment of the present disclosure.

Referring now to FIG. 19, the distributor 70 may have a shape generally complementary to a portion of a cross-section of the manifold 60. In the illustrated, non-limiting embodiment, the distributor 70 has a generally rectangular body with curved edges complementary to the curvature of the manifold 60 at a certain location. Refrigerant may be provided at a base of the manifold 60, as shown in FIG. 20, and is configured to pass through the plurality of distributor holes 74 formed in the distributor 70, for example in a vertical configuration, to one or more heat exchanger tubes 36. As illustrated in the embodiment of FIG. 19, a spacer 90 may be coupled to or integrally formed with a portion of the distributor 70 or the spacer 90 can be a separate component inserted into manifold 60. The spacer 90 can be disposed between the distributor 70 and one or more tubes 36 (e.g., multiport tubes such as in a microchannel heat exchanger). The spacer 90 may extend over only a portion of the length, or alternatively, over the full length of the distributor 70. In one embodiment, the spacer 90 includes a plurality of protrusions (see FIG. 19*a*), such as arranged in a linear orientation for example, and positioned at intervals over the length of the distributor 70. The spacer 90 can extend outward from a surface of the distributor 70 and can be configured to contact either a portion of one of more of the plurality of heat exchanger tubes 36, as shown in FIG. 19, or a portion of an internal wall of the manifold 60 to maintain a position of the distributor 70 relative to the tubes 36.

The spacer 90 can have any shape. For example, a cross-sectional shape of the spacer 90 can include circular, elliptical, or any polygonal shape having straight or curved sides. In one embodiment, the shape of the distributor 70 may be complementary to, and configured to contact, a portion of the manifold 60 or a tube 36 (e.g., contacting a solid portion adjacent to a port of a multiport tube, such as a web material between ports of a multiport tube) based on the overall distance between the spacer 90 and the tubes 36.

Figure 21:
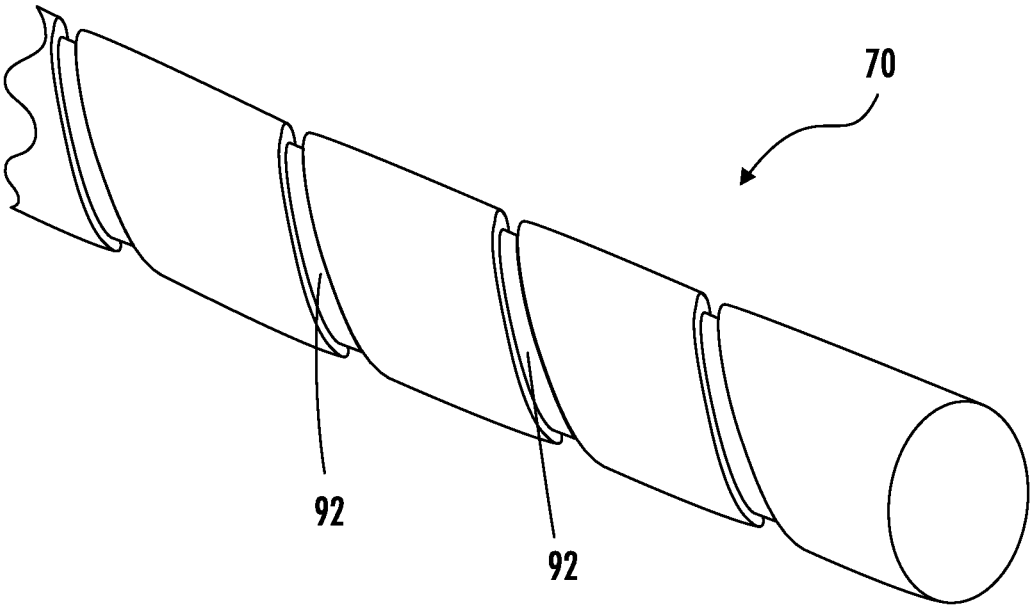
FIG. 21 is a perspective view of a portion of a distributor according to an embodiment of the present disclosure.

With reference now to FIG. 21, the one or more distributor holes 74 of previous embodiments formed in the distributor 70 may be formed as grooves 92 rather than holes 74. The grooves 92 may be individual, or alternatively, may be connected to form a continuous groove in an external surface of the distributor 70. The grooves 92 can have any shape. For example, the shape of the cross-sectional flow area of the grooves 92 can include circular, elliptical, or any polygonal shape having straight or curved sides. In the illustrated, non-limiting embodiment, the holes 74 are formed as a continuous groove 92 wrapped in a spiral configuration about a periphery of the distributor 70. However, other groove configurations, such as extending linearly along a surface of the distributor 70, or about only a portion of the circumference of the distributor 70 are within the scope of the present disclosure. Depending on the configuration of the grooves 92, one or more dividers (not shown) may be mounted to an exterior of the distributor 70 and configured to limit flow from the grooves 92 to one or more corresponding heat exchanger tubes 36.

The one or more grooves 92 formed in the distributor 70 are generally arranged at an angle to each of the plurality of heat exchanger tubes 36 such that one or more of the grooves do not directly face a corresponding tube 36. As a result, refrigerant from the grooves 92 is not directly injected into the plurality of tubes 36. The configuration of each groove, including the size and cross-sectional shape thereof, may be selected to control a flow of refrigerant from each groove 92 to a corresponding heat exchanger tube or tubes 36.

The distributor 70 can separate the inner volume of a manifold into a first manifold section 94 and a second manifold section 96. The volume of the first manifold section 94 may be less than or equal to the volume of the second manifold section 96. The one or more grooves 92 can define one of more flow passages between the first manifold section 94 and the second manifold section 96. A total cross-sectional flow area of the one or more grooves 92 of the distributor 70 is generally less than the cross-sectional area of the manifold 60. In one embodiment, the total cross-sectional flow area of the one or more grooves 92 is between about 50% and about 200% of the cross-sectional area of a first manifold section 94 (see FIG. 19). In an embodiment, the cross-sectional shape of the distributor 70 can be formed after the grooves 92 are formed into the distributor 70, such as through a machining process. In another embodiment, the distributor 70 can be formed into shape in a single operation (e.g., injection molding).

The various methods for reducing the inner volume 62 can provide significant benefits to the system at minimal additional cost. By reducing the inner volume 62 of a manifold 60 (e.g., an inlet, exit, or intermediate manifold) of a microchannel heat exchanger 20 the refrigerant charge of the heat exchanger 20 can be correspondingly reduced. Furthermore, the present methods can be employed while maintaining or improving the refrigerant distribution to the tubes 36 of the heat exchanger. In addition, such heat exchangers 20 are compatible for use with lower global warming potential refrigerants.

While the present disclosure has been particularly shown and described with reference to the exemplary embodiments as illustrated in the drawings, it will be recognized by those skilled in the art that various modifications may be made without departing from the spirit and scope of the present disclosure. Therefore, it is intended that the present disclosure not be limited to the particular embodiment(s) disclosed as, but that the disclosure will include all embodiments falling within the scope of the appended claims.

What is claimed is:

1. A heat exchanger comprising:

a first manifold;

a second manifold separated from the first manifold;

a plurality of heat exchanger tubes arranged in spaced parallel relationship and fluidly coupling the first manifold and the second manifold, a first end of each of the plurality of heat exchanger tubes extends partially into an inner volume of the first manifold; and a distributor positioned within the inner volume of the first manifold, wherein the distributor has an increased wall thickness to reduce the inner volume of the first manifold, wherein the wall thickness of the distributor is greater than a wall thickness of the first manifold.

2. The heat exchanger according to claim 1, wherein the first manifold is configured to receive at least a partially liquid refrigerant.

3. The heat exchanger according to claim 1, wherein the first manifold is asymmetric about a horizontal plane extending there through.

4. The heat exchanger according to claim 1, wherein the distributor occupies between about 20% and about 60% of the inner volume of the first manifold.

5. The heat exchanger according to claim 1, wherein the distributor occupies between about 30% and about 50% of the inner volume of the first manifold.

6. The heat exchanger according to claim 1, wherein the distributor is a circular, ellipsoid, or plate distributor.

7. The heat exchanger according to claim 1, wherein the distributor is configured to contact a portion of the first manifold inner wall; optionally wherein the distributor may have a shape generally complementary to a portion of a cross-section of the first manifold.

8. The heat exchanger according to claim 1, wherein the distributor is configured to contact at least one of the plurality of heat exchanger tubes.

9. The heat exchanger according to claim 1, further comprising a spacer positioned adjacent the distributor, the spacer being configured to set a position of the distributor within the inner volume of the first manifold; optionally wherein the spacer is integrally formed with a portion of the distributor.

10. The heat exchanger according to claim 9, wherein the spacer is configured to contact at least one of the plurality of heat exchanger tubes or wherein the spacer is configured to contact a portion of the first manifold inner wall.

11. The heat exchanger according to claim 9, wherein the spacer extends over a portion of a length of the distributor;

optionally wherein the spacer includes a plurality of protrusions extending over at least a portion of a length of the distributor.

12. The heat exchanger according to claim 7, wherein the distributor divides the manifold into a first manifold section and a second manifold section.

13. The heat exchanger according to claim 12, wherein the distributor further comprises a plurality of distributor holes which provide a flow passage between the first manifold section and the second manifold section.

14. The heat exchanger according to claim 12, wherein the distributor further comprises a groove formed in an exterior surface thereof, wherein the groove and an interior wall of the first manifold form a flow passage between the first manifold section and the second manifold section.

15. The heat exchanger according to claim 14, wherein the groove comprises a plurality of separate grooves; or wherein the groove comprises an interconnected groove.

* * * * *